US007255534B2

(12) United States Patent
Liang

(10) Patent No.: US 7,255,534 B2
(45) Date of Patent: Aug. 14, 2007

(54) GAS TURBINE VANE WITH INTEGRAL COOLING SYSTEM

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 35 days.

(21) Appl. No.: 10/884,441

(22) Filed: Jul. 2, 2004

(65) Prior Publication Data

US 2006/0002788 A1 Jan. 5, 2006

(51) Int. Cl.
*F01D 5/18* (2006.01)
*F01D 9/02* (2006.01)

(52) U.S. Cl. ..... 416/97 R; 415/115

(58) Field of Classification Search ..... 415/115; 416/97 R

See application file for complete search history.

(56) References Cited

U.S. PATENT DOCUMENTS 4,551,064 A 11/1985 Pask
4,573,865 A 3/1986 Hsia et al.
4,601,638 A 7/1986 Hill et al.
4,664,597 A * 5/1987 Auxier et al. ..... 416/97 R
4,726,735 A * 2/1988 Field et al. ..... 416/97 R
5,169,287 A 12/1992 Proctor et al.
5,368,441 A 11/1994 Sylvestro et al.
5,405,242 A * 4/1995 Auxier et al. ..... 415/115
5,584,651 A 12/1996 Pietraszkiewicz et al.
5,772,397 A 6/1998 Morris et al.
6,004,095 A 12/1999 Waitz et al.
6,153,889 A * 11/2000 Jones ..... 416/97 R
6,234,754 B1 5/2001 Zelesky et al.
6,402,470 B1 * 6/2002 Kvasnak et al. ..... 416/97 R
6,616,405 B2 9/2003 Torii et al.
6,616,406 B2 9/2003 Liang

* cited by examiner

*Primary Examiner*—Richard A. Edgar

(57) ABSTRACT

A turbine vane usable in a turbine engine and having at least one cooling system. The cooling system includes three diffusors in an outer wall of the vane for reducing the velocity of the cooling fluids exiting the turbine vane. One of the diffusors is formed from one or more cavities in an outer wall of the turbine vane for heat dissipation. The cavities may be supplied with cooling fluids from an internal cooling cavity through one or more interior metering orifices. The cooling fluids may exit the cooling cavity through one or more exterior metering orifices, which are second diffusors, and diffusion slots, which are third diffusors, that reduce the velocity of the cooling fluids and enable formation of a film cooling layer on the outer surface of the turbine vane.

6 Claims, 4 Drawing Sheets

GAS TURBINE VANE WITH INTEGRAL COOLING SYSTEM

FIELD OF THE INVENTION

This invention is directed generally to turbine vanes, and more particularly to hollow turbine vanes having cooling channels for passing fluids, such as air, to cool the vanes.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to an inner endwall. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to maintain all aspects of the turbine vane at a relatively uniform temperature. At least some of the air passing through these cooling circuits is exhausted through orifices in the leading edge, trailing edge, suction side, and pressure side of the vane. While advances have been made in the cooling systems in turbine vanes, a need still exists for a turbine vane having increased cooling efficiency for dissipating heat and passing a sufficient amount of cooling air through the vane.

SUMMARY OF THE INVENTION

This invention relates to a turbine vane having an internal cooling system for removing heat from the turbine vane. The turbine vane may be formed from a generally elongated hollow airfoil having a leading edge, a trailing edge, a pressure side, a suction side, a first end adapted to be coupled to a hook attachment, a second end opposite the first end and adapted to be coupled to a inner endwall, and a cooling system in the hollow airfoil formed from at least one internal cooling cavity. The cooling system may include at least one cavity in the outer wall of the hollow airfoil. The cavity acts as a diffusion slot in the cooling system to reduce the velocity of cooling fluids flowing from the turbine blade. The cooling cavity combines with other configurations to form one of three diffusors in the outer wall of the turbine blade.

The cooling system may also include one or more interior metering orifices creating a fluid pathway between the internal cooling cavity and the at least one cavity in the outer wall. The cooling system may also include one or more exterior metering orifices creating a fluid pathway between the at least one cavity in the outer wall and the outer surface of the generally elongated hollow airfoil.

The cooling system may have one or a plurality of cavities in the outer wall. The size and shape of the cavity may be determined based on the desired local temperature of the outer wall of the airfoil proximate to the cavity and based on the pressure distribution in the spanwise and chordwise directions. In at least one embodiment, the cavity may have a generally cubical shape. The cavities may be aligned into rows extending in the spanwise direction and aligned into rows in the chordwise direction. The cavities may also be offset, which may also be referred to as staggered, in the chordwise or spanwise directions, or in both directions.

The cooling system may also include one or more interior metering orifices that meter the flow of cooling fluids into the cavities in the outer wall and create impingement cooling in the cavities in the outer wall. In at least one embodiment, each cavity may have one or more interior metering orifices that provide a pathway for cooling fluids to flow from the internal cooling cavity to the cavities. The interior metering orifices may be generally cylindrical or, in other embodiments, may be formed from other appropriate shapes. In at least one embodiment, a cavity may be feed with cooling fluids through four interior metering orifices.

The cooling system may also include one or more exterior metering orifices that meter the flow of cooling fluids from the cavities in the outer wall to be released proximate to the outer surface of the outer wall and act as diffusors by spreading cooling fluids across the turbine blade. The exterior metering orifices may have different sizes and configurations for metering the flow of cooling fluids. The exterior metering slots may extend from side surfaces of the cavity in the outer wall of the hollow airfoil or other appropriate location. The exterior metering orifices may also have generally bell-shaped mouths. The exterior metering orifices may be coupled to one or more diffusion slots for reducing the velocity of cooling fluids flowing from the exterior metering orifices. The diffusion slots may be positioned to couple together exterior metering slots from a single cavity or from a plurality of cavities.

An advantage of this invention is the cavities in the outer wall of the hollow airfoil may be sized and shaped appropriately to account for localized pressures and heat loads to more effectively use available cooling fluids.

Another advantage of this invention is that the cooling system includes two layers of metering systems, interior and exterior metering orifices, which meter flow into the cavities in the outer wall, and meter flow to outer surfaces of the airfoil, respectively. These features enable cooling fluids to be discharged from the airfoil and form a coolant sub-boundary layer proximate to an outer surface of the airfoil.

Yet another advantage of this invention is that the combination of multiple hole impingement cooling and multiple diffusion slots having high surface area coverage yields very high cooling effectiveness and uniform wall temperature for the airfoil main body wall.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
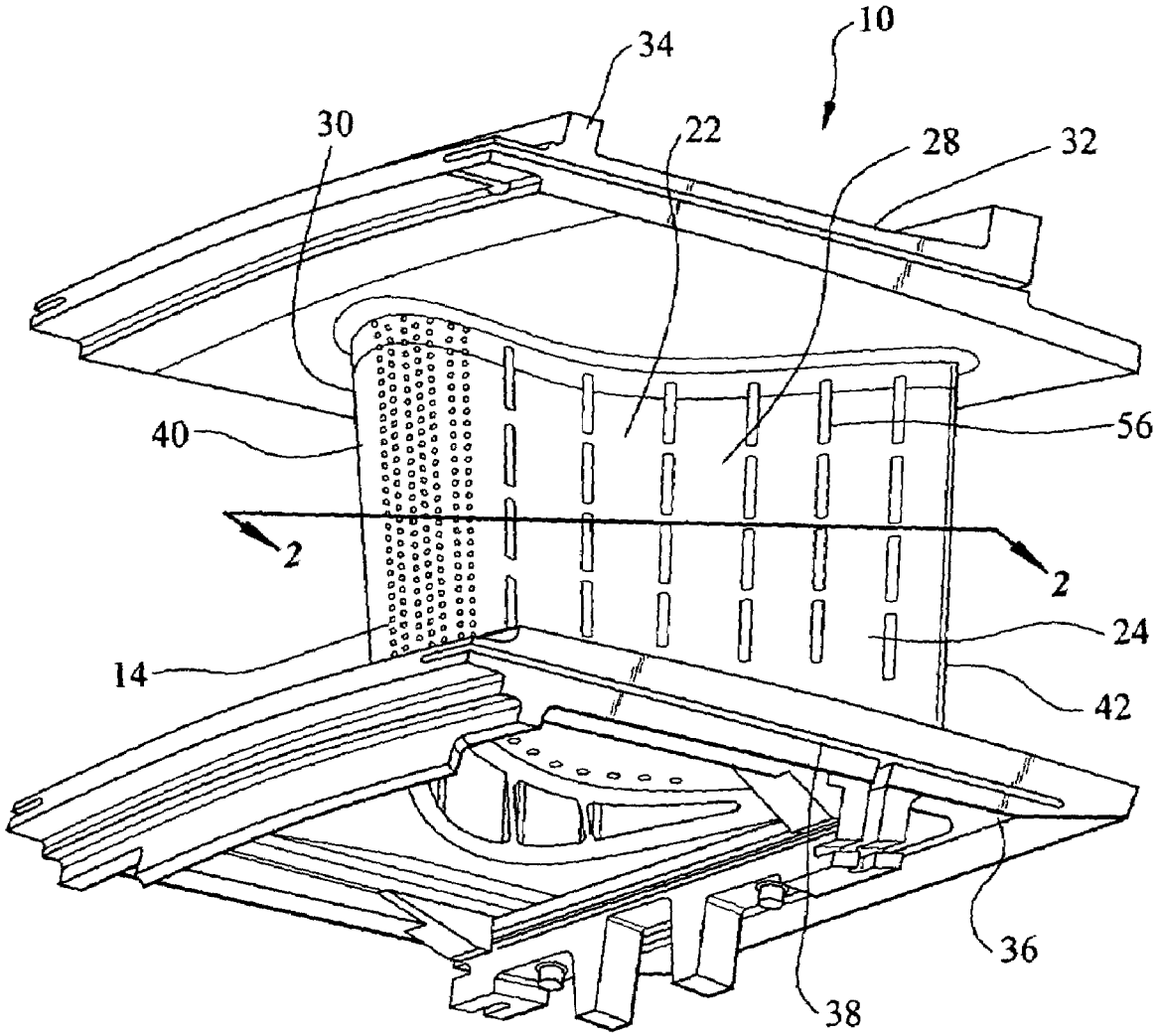
FIG. 1 is a perspective view of a turbine vane having features according to the instant invention.

As shown in FIGS. 1-5, this invention is directed to a turbine vane 10 having a cooling system 12 in inner aspects of the turbine vane 10 for use in turbine engines. The cooling system 12 may be used in any turbine vane or turbine blade. While the description below focuses on a cooling system 12 in a turbine vane 10, the cooling system 12 may also be adapted to be used in a turbine blade. The cooling system 12 may be configured such that adequate cooling occurs within an outer wall 14 of the turbine vane 10 by including one or more cavities 16 in the outer wall 14 and configuring each cavity 16 based on local external heat loads and airfoil gas side pressure distribution in both chordwise and spanwise directions. The cooling system 12 includes three elements, cavity 16, exterior metering orifices 52, and diffusion slots 56 that act as diffusors in the cooling system 12 to reduce the velocity of cooling fluids passing from the turbine vane 10.

As shown in FIG. 1, the turbine vane 10 may be formed from a generally elongated airfoil 22 having an outer surface 24 adapted for use, for example, in an axial flow turbine engine. Outer surface 24 may have a generally concave shaped portion forming pressure side 28 and a generally convex shaped portion forming suction side 30. The turbine vane 10 may also include an outer endwall 32 adapted to be coupled to a hook attachment 34 and may include a second end 36 adapted to be coupled to a inner endwall 38. The airfoil 22 may also include a leading edge 40 and a trailing edge 42.

Figure 2:
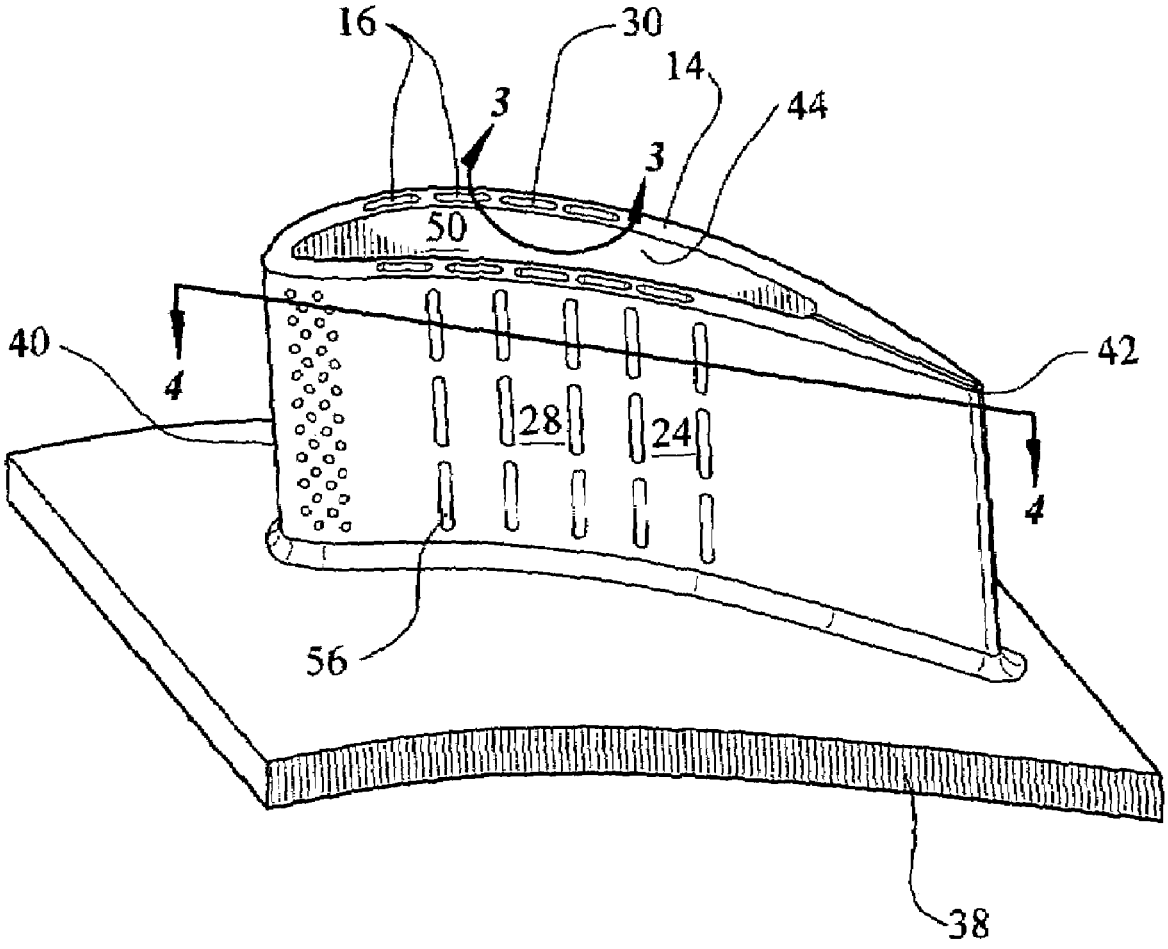
FIG. 2 is a cross-sectional view of the turbine vane shown in FIG. 1 taken along line 2-2.
Figure 3:
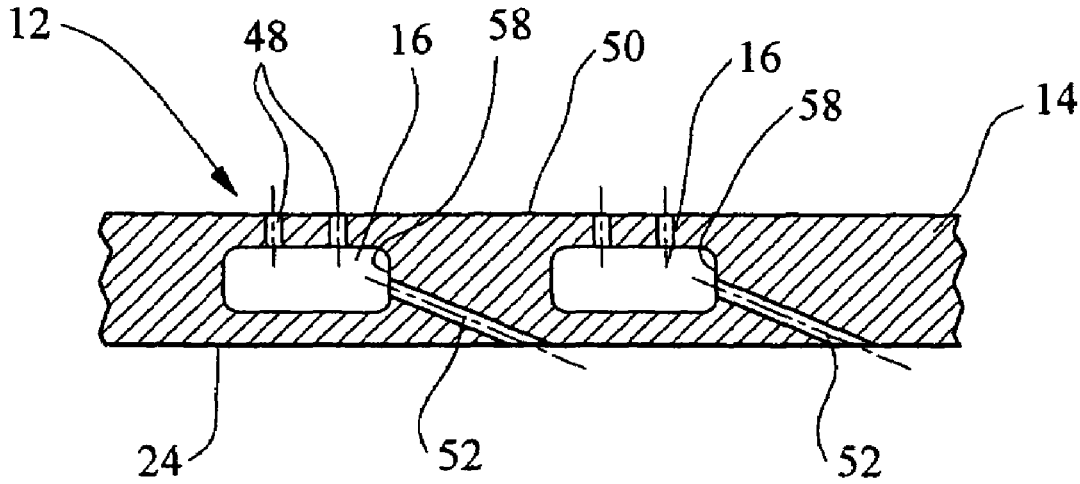
FIG. 3 is a partial cross-sectional view of the turbine vane shown in FIG. 2 taken at detail 3.
Figure 4:
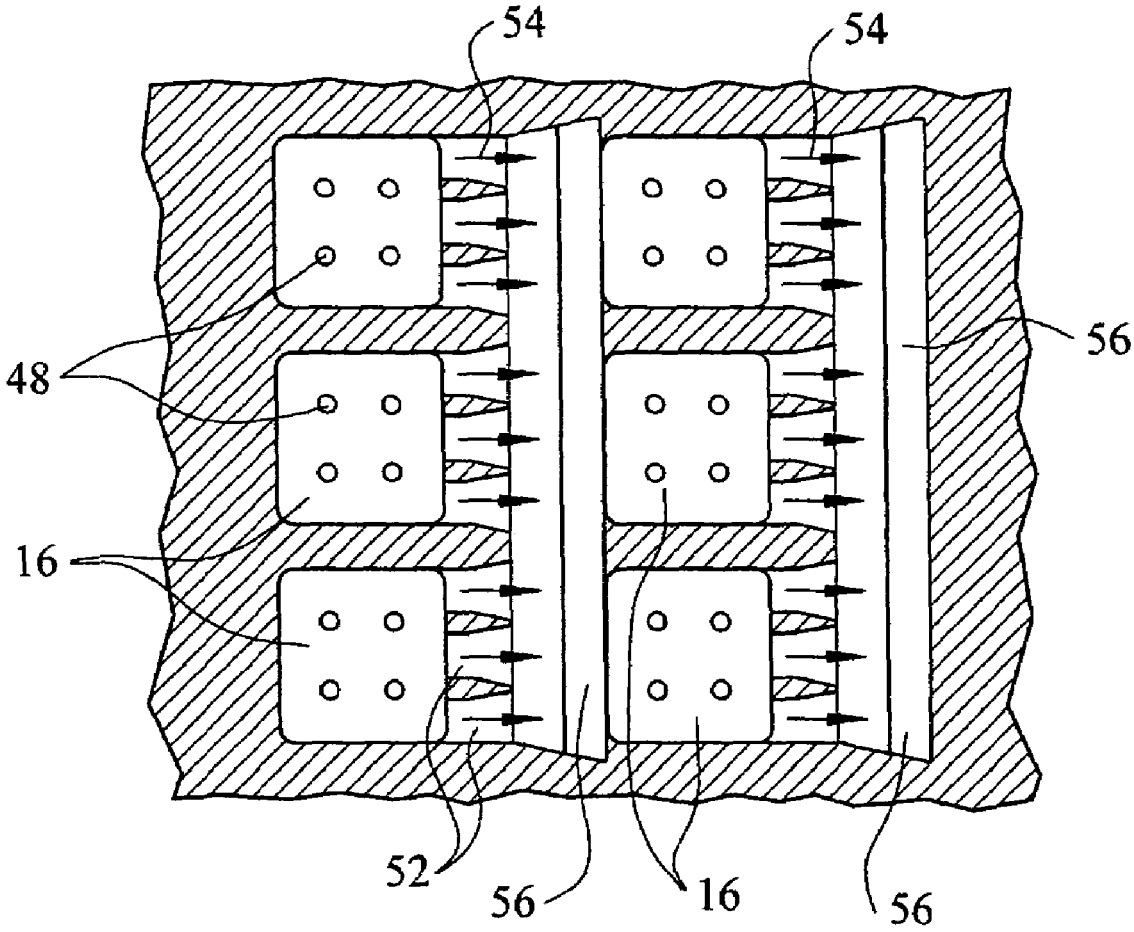
FIG. 4 is a bottom view of the partial cross-sectional view of the turbine vane shown in FIG. 3.
Figure 5:
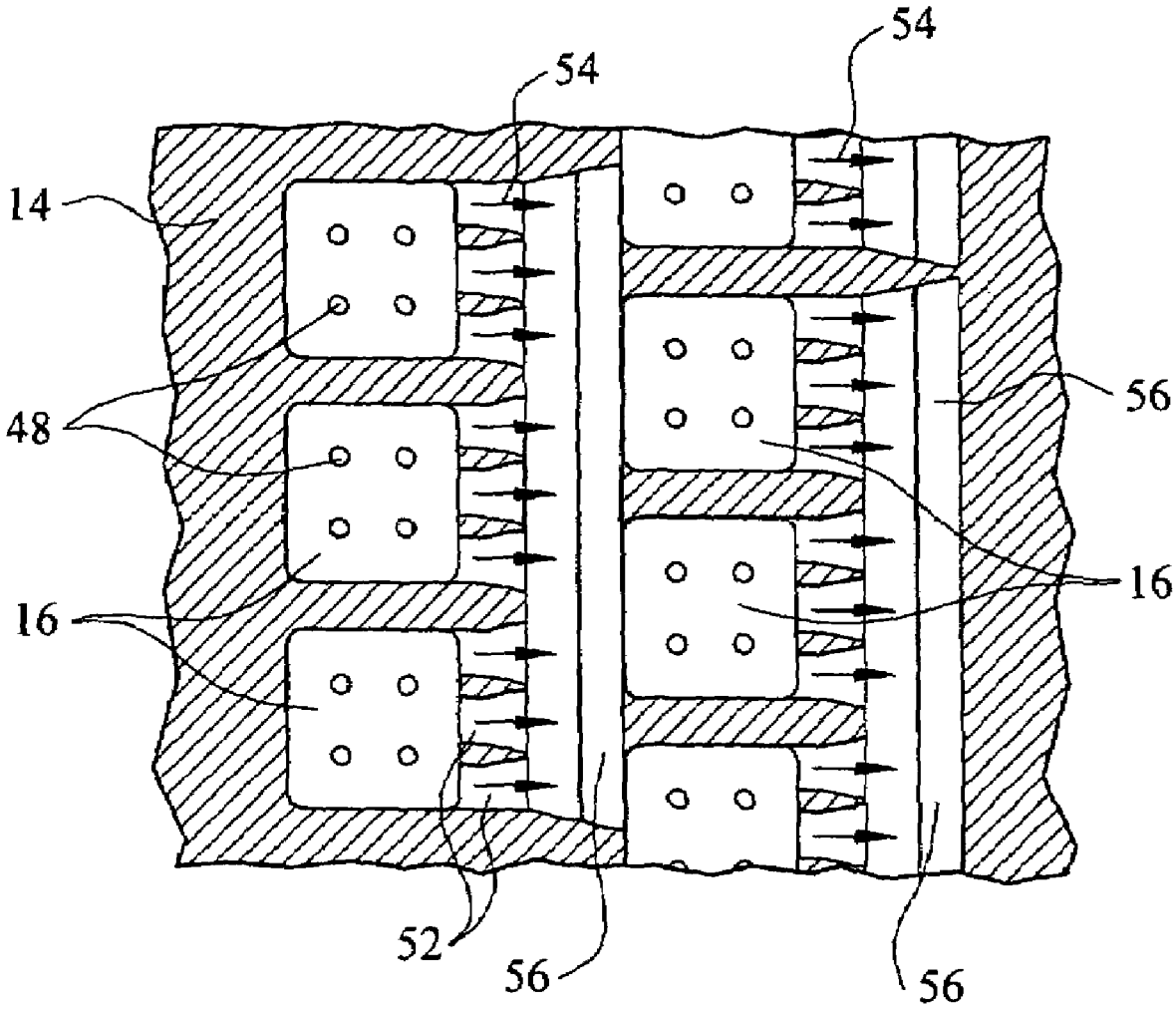
FIG. 5 is a bottom view of a partial cross-sectional view of an alternative embodiment of the invention shown in FIG. 4.

As shown in FIG. 2, the cooling system 12 may be formed from at least one internal cooling cavity 44, which may have any number of configurations sufficient to remove a desired amount of heat from the turbine vane 10. The cooling system 12 may also include one or more cavities 16 in the outer wall 14. The cavity 16 acts a diffusor by reducing the velocity of the cooling fluids flowing through the turbine vane 10. The cavity 16 is one of three diffusors in the cooling system 12. The cavities 16 may receive cooling fluids from the internal cooling cavity 44, transfer heat to the cooling fluid through convection, and expel the cooling fluid to be used in film cooling applications on the outer surface 24 of the airfoil 22. The cavities 16, as shown in FIG. 4, may be positioned spanwise in rows, or may be staggered spanwise, as shown in FIG. 5. The cavities 16 may be configured into any shape capable of removing desired quantities of heat from the airfoil 22. In at least one embodiment, as shown in FIG. 3, the cavity 16 may have a generally cubical shape; however, every side of the cavity 16 does not necessarily have to be of equal length and size.

The cooling system 12 may also include one or more interior metering orifices 48 providing a pathway between the internal cooling cavity 44 and the cavity 16 in the outer wall 14 and creating impingement cooling in the cavity 16. The interior metering orifices 48 may be sized to control the flow rate of cooling fluids into the cavity 16. In at least one embodiment, as shown in FIG. 3, the interior metering orifices 48 may be positioned generally orthogonal relative to an inner surface 50 forming the internal cooling cavity 44. In addition, a plurality of interior metering orifices 48 may be used to provide a pathway for cooling fluids to pass into the cavities 16. For instance, in at least one embodiment, as shown in FIG. 4, each cavity 16 may have four interior metering orifices 48 providing a pathway for cooling fluid to flow into the cavity 16. The cooling system 12 is not limited to this particular number of interior metering orifices 48; rather, the cooling system 12 may have any number of interior metering orifices 48 that adequately provides the appropriate amount cooling fluid flow.

The cooling system 12 may also include one or more exterior metering orifices 52 providing a pathway between the cavity 16 in the outer wall 14 and the outer surface 24 of the hollow elongated airfoil 22. The exterior metering orifices 24 meter the flow of cooling fluids to the outer surface 24 to create a film of cooling fluids on the outer surface 24 of the airfoil. The exterior metering orifices 24 also act as second diffusors downstream of the first diffusors, the cavities 16. Thus, the exterior metering orifices 24 provide a second layer of metering orifices for cooling fluids to flow through in the outer wall 14. The exterior metering orifices 52 may have a bell shaped mouth 54, as shown in FIGS. 4 ands 5, or other appropriate shape. Each cavity 16 may have any number of exterior metering orifices 52. In at least one embodiment, as shown in FIGS. 4 and 5, each cavity 16 may be in communication with three exterior metering orifices 52. The exterior metering orifices 52 may extend from a side surface 58 of the cavity 16 in the outer wall 14 of the hollow airfoil 22. In other embodiments, the exterior metering orifices 52 may extend from other areas of the cavities 16. The exterior metering orifices 52 may be positioned nonorthogonally to the outer surface 24 to expel air from the airfoil 22 generally in the downstream direction of fluid flow across the turbine vane 10. In other words, the exterior metering orifices 52 may be positioned to expel air towards the trailing edge 42 of the airfoil 22.

As shown in FIGS. 4 and 5, the cooling system 12 may include one or more diffusion slots 56 in communication with the exterior metering orifices 52. The diffusion slots 56 form a third diffusor downstream of the exterior metering orifices 52. The diffusion slots 56 may extend substantially an entire spanwise length of the airfoil 22 or be formed from other appropriate lengths. The diffusion slots 56 may extend between adjacent cavities 16 and sets of exterior metering orifices 52. In another embodiment, as shown in FIG. 1, the diffusion slots 56 may be positioned in a spanwise row and continuous only between exterior metering slots 52 extending from a single cavity 16. The diffusion slots 56 reduce the velocity of cooling fluids flowing from the exterior metering orifices 52 and therefore, reduce turbulence in the film layers proximate to the outer surface 24.

During operation, the cooling fluids flow through the internal cooling cavity 44 of the turbine vane 10. At least a portion of the cooling fluids flow into the interior metering orifices 48 and into the cavities 16 where the cooling fluids remove heat from the walls forming the cavities 16. The interior metering orifices 48 meter the flow of cooling fluids into the cavities 16. The cooling fluids flow into the exterior metering orifices 52 and through the diffusion slots 56 where the cooling fluids form a layer on the outer surface 24 of the airfoil 22. The diffusion slots 56 reduce the velocity of the cooling fluids flowing from the exterior metering orifices 52, which thereby limits the formation of turbulence in the boundary layer of film cooling fluids proximate to the outer surface 24. Thus, a boundary layer of cooling fluids may be formed with the cooling fluids exhausted from the diffusion slots 56 to reduce the temperature of the outer surface 24 of the airfoil 22.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine vane, comprising:

a generally elongated hollow airfoil formed from an outer wall having a leading edge, a trailing edge, a pressure side, a suction side, a first end adapted to be coupled to a hook attachment, a second end opposite the first end adapted to be coupled to an inner endwall, and a cooling system in the hollow airfoil formed from at least one internal cooling cavity;

a plurality of first diffusors, each formed from a plurality of cavities in the outer wall of the generally elongated hollow airfoil aligned spanwise into rows;

a plurality of interior metering orifices creating fluid pathways between the internal cooling cavity and the plurality of cavities in the outer wall forming the first diffusors, wherein at least one of the interior metering orifices is generally orthogonal relative to an inner surface of the outer wall;

a plurality of second diffusors, each formed from a plurality of exterior metering orifices creating fluid pathways between the plurality of cavities forming the first diffusors in the outer wall and an outer surface of the generally elongated hollow airfoil; and wherein each of the first diffusors are formed from a linear flowpath in direct fluid communication with and aligned with a linear flow path of the second diffusors;

a third diffusor formed from a diffusion slot extending spanwise in the airfoil and coupled to the plurality of exterior metering orifices;

wherein the diffusion slot extends spanwise between adjacent sets of exterior metering slots at the outer surface of the generally elongated hollow airfoil, thereby placing the diffusion slot in fluid communication with a plurality of first diffusors.

2. The turbine vane of claim 1, wherein at least one of the exterior metering orifices extends nonorthogonally from an outer surface of the outer wall to expel cooling fluid from the airfoil generally in a downstream direction.

3. The turbine vane of claim 1, wherein the plurality of interior metering orifices comprise four generally cylindrical interior metering orifices in connection with each cavity in the outer wall of the hollow airfoil.

4. The turbine vane of claim 1, wherein the exterior metering orifices comprise a generally bell shaped mouth at an outer surface of the outer wall.

5. The turbine vane of claim 1, wherein the exterior metering orifices extend from side surfaces of the cavities in the outer wall of the hollow airfoil to the outer surface of the generally elongated hollow airfoil.

6. The turbine vane of claim 1, wherein the plurality of cavities in rows are staggered in the spanwise direction in the airfoil.

* * * * *